United States Patent [19]

Odenthal

[11] Patent Number: 4,977,348

[45] Date of Patent: Dec. 11, 1990

[54] ELECTRON DISCHARGE TUBE WITH BIPOTENTIAL ELECTRODE STRUCTURE

[75] Inventor: Conrad J. Odenthal, Portland, Oreg.

[73] Assignee: Tektronix, Inc., Beaverton, Oreg.

[21] Appl. No.: 320,657

[22] Filed: Mar. 7, 1989

[51] Int. Cl.[5] ..... H01J 29/46

[52] U.S. Cl. ..... 313/479; 313/436; 313/450

[58] Field of Search ..... 313/479, 449, 450, 436, 313/414; 315/370, 382

[56] References Cited

U.S. PATENT DOCUMENTS

| | | | |
|---|---|---|---|
| 2,545,120 | 3/1951 | Swedlund | 313/479 X |
| 3,355,617 | 11/1967 | Schwartz et al. | 313/291 |
| 4,374,344 | 2/1983 | Misono et al. | 313/479 |
| 4,665,340 | 5/1987 | Odenthal et al. | 313/449 |
| 4,672,276 | 6/1987 | Odenthal et al. | 315/382 |

*Primary Examiner*—Donald J. Yusko

*Assistant Examiner*—Michael Horabik

*Attorney, Agent, or Firm*—John D. Winkelman; Mark M. Meininger

[57] ABSTRACT

A cathode-ray tube (54) includes a bipotential electrode structure (50) that converges the electrons in an electron beam. The bipotential electrode structure includes a cylindrical metallic electrode (56) positioned within a neck portion (66) of an evacuated glass envelope (52) and an electrically resistive coating (58) on an interior surface (60) of the neck portion. The resistive coating has a terminal end (64) positioned adjacent the metallic electrode. An electrically and thermally conductive coating (62) on the interior surface of the neck portion covers the terminal end of the resistive coating and partly overlaps the metallic electrode. The conductive coating functions to prevent electric "punch-through" between the interior and exterior surfaces of the tubular envelope. The conductive coating also allows relatively efficient operation of a beam deflection apparatus.

18 Claims, 3 Drawing Sheets

ELECTRON DISCHARGE TUBE WITH BIPOTENTIAL ELECTRODE STRUCTURE

TECHNICAL FIELD

The present invention relates to electron discharge tubes and, in particular, to a cathode-ray tube that employs a bipotential electrode structure for converging an electron beam as it propagates toward a display screen.

BACKGROUND OF THE INVENTION

Certain cathode-ray tubes employed in, for example, high resolution graphics display systems, include a bipotential lens structure for focusing an electron beam as it propagates toward a display screen. The bipotential lens structure typically includes an overlapping pair of electrically isolated, cylindrical electrodes. A potential difference applied between the cylindrical electrodes generates an electric field that directs electrons in the beam toward the central longitudinal axis of the tube, thereby to focus the electron beam as it propagates toward the display screen.

A cathode-ray tube includes an evacuated glass envelope within which the electron beam propagates along the central longitudinal axis from an electron gun toward the display screen. In one type of bipotential lens structure, the pair of cylindrical electrodes are formed by a metallic cylinder electrode positioned within the neck portion of the glass envelope and an electrically resistive coating on an interior surface of the neck portion. The resistive coating partly overlaps the metallic electrode and is itself overlapped by a magnetic deflection yoke positioned outside the evacuated envelope. The deflection yoke scans the electron beam across the display screen in a raster pattern.

A bipotential lens that employs a resistive coating as one of the cylindrical electrodes is desirable because it is relatively inexpensive to manufacture. Such a lens structure suffers, however, from the disadvantage of causing the evacuated envelope to rupture when an electric arc of sufficiently high current develops between the metallic electrode and the resistive coating.

In particular, the lens structure generates large electric field gradients near the end of the resistive coating where it partly overlaps the metallic electrode. Whenever an arc occurs between the metallic electrode and the resistive coating, a large electric current at a relatively high voltage is delivered through the coating. The impedance of the resistive coating, together with the electric field gradients near its end, causes the current in the arc to be localized on the surface of the glass envelope near the end of the coating.

The relatively large, localized current in an arc raises the temperature of the glass envelope, and the increased temperature of the glass envelope increases its conductivity. As a result, the temperature of and the current in the glass envelope near the end of the resistive coating increase. Such temperature and current increases can occur until a second arc is generated between the interior surface of the glass envelope and its exterior surface. The second arc, which is called "punch-through", ruptures the glass envelope and thereby destroys the cathode-ray tube.

Uncontrolled arcs between the cylinder electrode and the resistive coating may occur during normal operation of the cathode-ray tube or during the conditioning of the cylinder electrode to eliminate field emission locations on its surface. Such conditioning is a processing step in the manufacture of cathode-ray tubes and is called "spot knocking." During the spot knocking process, the field emission locations (e.g., contamination on the surface of the metallic electrode) are eliminated by generating current-controlled arcs between the metallic electrode and the resistive coating. Typically, the arc current is selected so that it is sufficient to "burn-off" the field emission locations but is insufficient to cause punch-through.

FIG. 1 is a schematic longitudinal section view of a prior art bipotential electron lens structure 10 positioned in a glass envelope 12 of a cathode-ray tube 14. Bipotential lens 10 includes an inner cylindrical electrode 16 and a partly overlapping outer cylindrical electrode 18 that are axially aligned with a central longitudinal axis 20. Outer cylindrical electrode 18 is supported within a neck portion 22 of glass envelope 12 by a pair of snubbers **24*a* and 24*b*, which provide an electrical connection between outer cylindrical electrode 18 and an electrically resistive coating 26 on the interior surface 28 of envelope 12. Resistive coating 26 is overlapped by a magnetic deflection yoke 30 positioned outside glass envelope 12**.

Outer cylindrical electrode 18 includes a particle trap 32 to which snubbers **24*a* and 24*b* are attached, as described, for example, in U.S. Pat. No. 4,665,340 of Odenthal et al. for "Cathode-Ray-Tube Electrode Structure Having a Particle Trap", issued May 12, 1987. Trap 32 includes a metal disk 34 that extends across neck portion 22 of envelope 12. An axially aligned central aperture 36 in metal disk 34 includes a cylindrical axial flange 38 that extends toward the display screen (not shown) of tube 14**.

Particle trap 32 and snubber **24*a* extend completely across neck portion 22 of envelope 12 to provide a "cup-like" configuration that collects particles propagating from a funnel portion 40 of tube 14. Such particles may include, for example, contamination that is dislodged from funnel portion 40 and that could establish field emission points on inner electrode 16, or secondary electrons that are emitted from funnel portion 40 and that could provide the current to support an uncontrolled arc between electrodes 16 and 18**.

Bipotential lens structure 10 reduces the incidence of "punch-through" because an arc between electrodes 16 and 18 does not directly contact interior surface 28 of envelope 12. It will be appreciated, however, that the manufacture of particle trap 32 is relatively expensive compared to a bipotential lens employing a resistive coating alone. In addition, the combined width 42 of outer cylinder electrode 18 and snubbers **24*a* and 24*b* allows eddy currents to be generated therein by deflection yoke 30. Such eddy currents draw energy from the deflection fields generated by yoke 30** and thereby reduce the power with which it interacts with the electron beam.

SUMMARY OF THE INVENTION

An object of this invention is, therefore, to provide a cathode-ray tube having a bipotential electrode structure that is relatively inexpensive to manufacture.

Another object of this invention is to provide such a tube in which the bipotential electrode structure reduces the incidence of "punch-through."

A further object of this invention is to provide such a tube in which the bipotential electrode structure does not interfere with the efficient operation of a magnetic deflection yoke.

The present invention is a bipotential electrode structure for use in a cathode-ray tube that preferably includes a magnetic deflection yoke. The bipotential electrode structure includes a cylindrical metallic electrode positioned within a neck portion of an evacuated glass envelope and an electrically resistive coating on an interior surface of the neck portion. The resistive coating has a terminal end positioned adjacent the metallic electrode. An electrically and thermally conductive coating on the interior surface of the neck portion covers the terminal end of the resistive coating and partly overlaps the metallic electrode.

The conductive coating reduces the incidence of "punch-through" because its high electrical and thermal conductivity characteristics disperse the effects of an arc between the tubular electrode and the resistive coating. In addition, the conductive coating is formed as a relatively narrow annular strip so that the magnitude of eddy currents generated in it by the deflection yoke is relatively small. As a result, the conductive coating allows the deflection yoke to interact with the electron beam in a relatively efficient manner.

Additional objects and advantages of the present invention will be apparent from the following detailed description of a preferred embodiment thereof, which proceeds with reference to the accompanying drawings.

DETAILED DESCRIPTION OF PREFERRED EMBODIMENT

Figure 2:
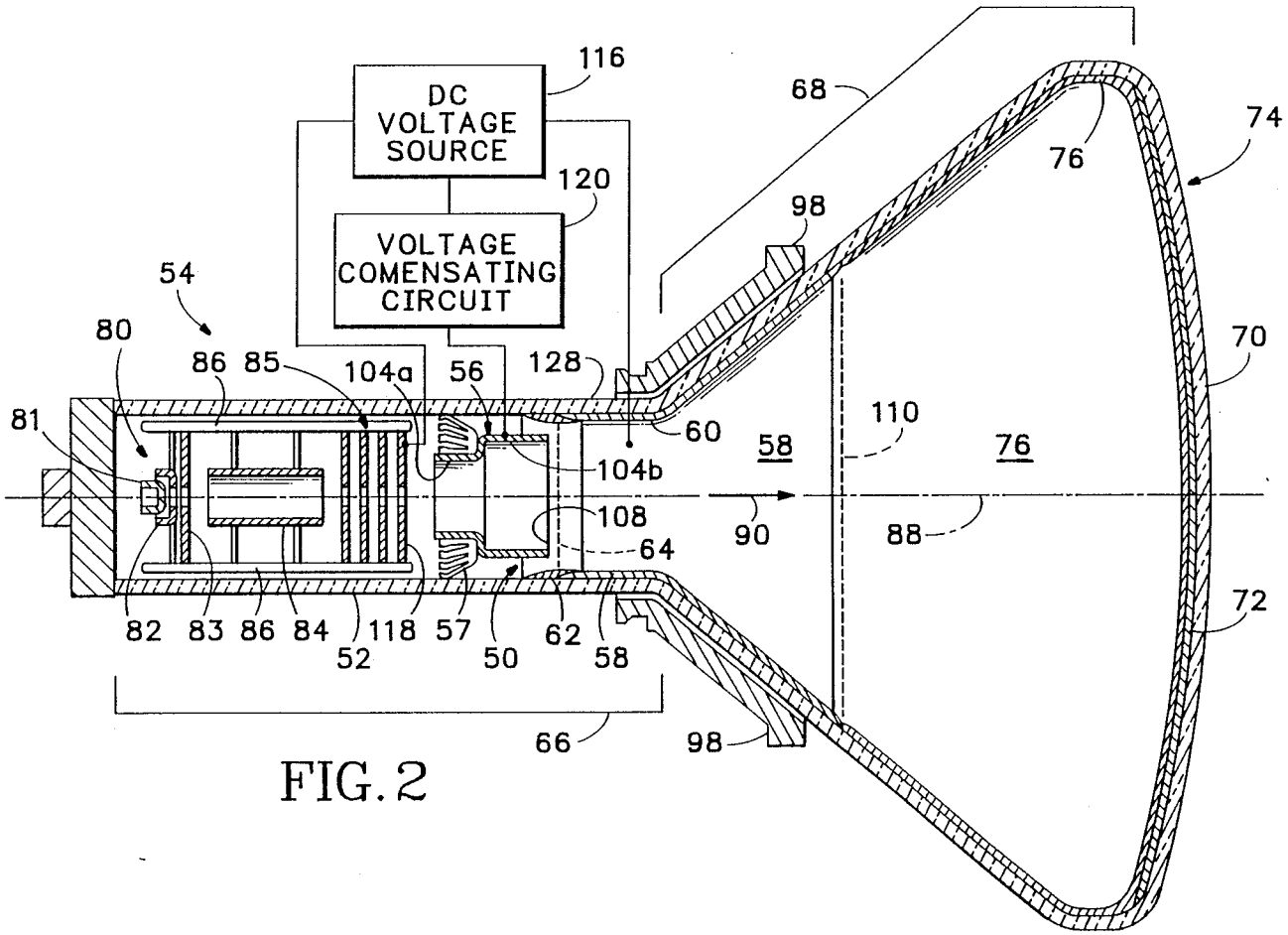
FIG. 2 is a longitudinal section view of a cathode-ray tube incorporating a bipotential electrode structure of the present invention.

With reference to FIG. 2, a bipotential electrode means or structure 50 of the present invention is contained within an evacuated envelope 52 of a cathode-ray tube 54. Bipotential electrode structure 50 includes a tubular electrode element 56 supported by a snubber 57, a resistive layer 58 positioned on an interior surface 60 of envelope 52, and a strip 62 of electrically and thermally conductive material positioned on interior surface 60. Conductive strip 62 covers a first terminal end 64 of resistive layer 58 and overlaps a portion of tubular electrode element 56.

Envelope 52 includes a tubular glass neck 66, a glass funnel 68, and an optically transparent glass faceplate 70. A layer 72 of phosphor material is deposited on the inner surface of faceplate 70 to form the display screen 74 of cathode-ray tube 54. An electron-transparent aluminum film 76 is deposited by evaporation on the inner surface of phosphor layer 72 and an adjacent portion of glass funnel 68 to provide a high-voltage electrode for display screen 74.

An electron gun 80, which includes a cathode 81, a control grid 82, a G2 electrode 83, an anode 84, and a quadrupole lens assembly 85, is supported by glass rods 86 at one end of cathode-ray tube 54. Electron gun 80 produces a beam of electrons that propagate generally along a central longitudinal axis 88 in a direction 90 toward display screen 74. Tubular electrode element 56 and interior surface 60 of glass neck 66 are axially aligned with central longitudinal axis 88. A DC voltage source (not shown) applies an electrical potential of 0–120 volts to cathode 81, 100–500 volts to G2 electrode 83, and about +5 kV to anode 84, thereby to accelerate electrons emitted by cathode 81 toward and through anode 84. Control grid 82, which is a ground potential, cooperates with G2 electrode 83 to control electron beam current. The potential on the G2 elecrode controls the cathode cut-off voltage.

Quadrupole lens assembly 85, which is disposed between anode 84 and bipotential electrode structure 50, corrects for astigmatism distortion of the electron beam. The construction and operation of such lens assembies is described in U.S. Pat. No. 4,672,276 of Odenthal et al. for "CRT Astigmatism Correction Apparatus With Stored Correction Values." A magnetic deflection yoke 98 is positioned between bipotential electrode structure 50 and display screen 74 for scanning the electron beam across the display screen in a conventional raster-scan pattern. Deflection yoke 98 includes, for example, a horizontal deflection coil (not shown) and a vertical deflection coil (not shown) that deflect the electron beam in a horizontal direction and a vertical direction, respectively.

Figure 4:
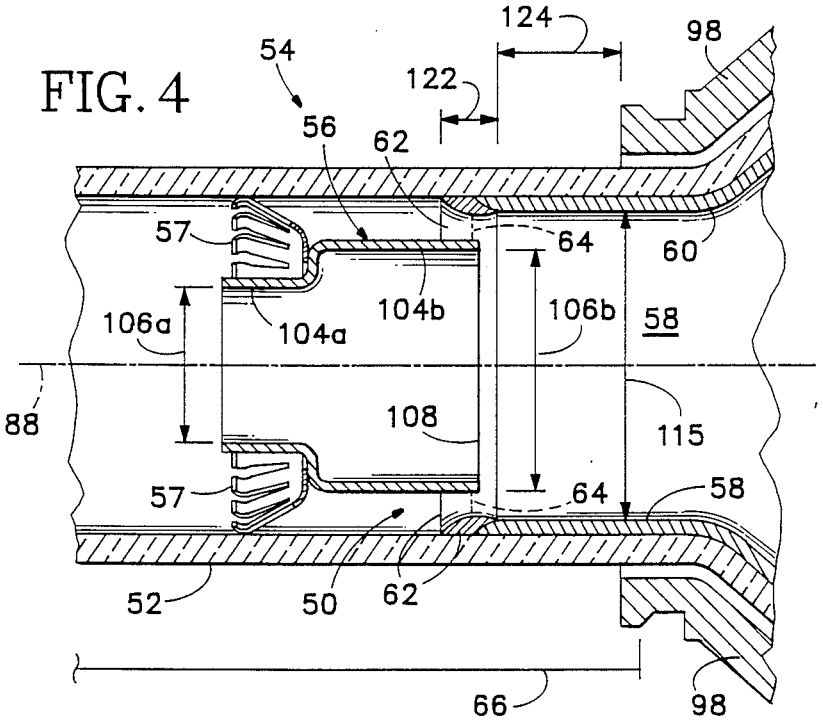
FIG. 4 is an enlarged fragmentary side elevation view of the bipotential electrode structure of FIG. 2.

Tubular electrode element 56 includes a first cylindrical portion **104*a* having a first inner diameter 106*a* (FIG. 4) and a second cylindrical portion 104*b* having a second inner diameter 106*b* (FIG. 4). Second diameter 106*b* is greater than first diameter 106*a*. A first electrical potential applied to tubular electrode element 56 and a second electrical potential applied to resistive layer 58 and conductive strip 62 cooperate to generate electron beam-focusing electric fields that are located within tubular electrode element 56**, as will be described below in greater detail.

Terminal end 64 of resistive layer 58 is in approximate alignment with the output end 108 of electrode element 56. Resistive layer 58 extends from first terminal end 64 to a second terminal end 110 that is covered by aluminum film 76. Terminal ends 64 and 110 of resistive layer 58 are positioned at opposite sides of deflection yoke 98. The electrical impedance of resistive layer 58 inhibits, therefore, the generation of eddy currents in the region of envelope 52 surrounded by yoke 98. Resistive layer 58 includes, for example, a conventional resistive "DAG" that is applied to interior surface 60 in a conventional manner.

Figure 3:
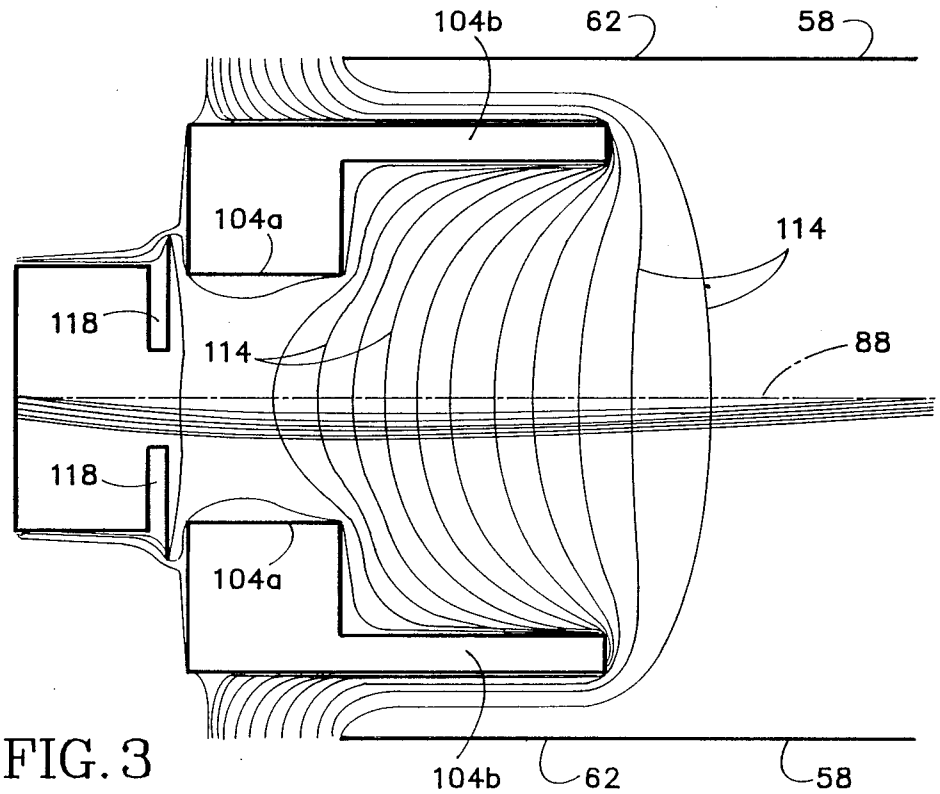
FIG. 3 is a computer-generated map of exemplary equipotential surfaces generated by the bipotential electrode structure of FIG. 2.

FIG. 3 is a computer-generated cross section of electron beam-focusing equipotential surfaces 114 developed by applying a potential difference between tubular electrode element 56 and the outer electrode element formed by resistive layer 58 and conductive strip 62. During operation of cathode-ray tube 54, a first DC voltage source 116 (FIG.2) delivers an electrical potential of about +30 kilovolts to resistive layer 58 and conductive strip 62 and an electrical potential of about +5 kilovolts to an output electrode 118 of quadrupole lenses 85. In addition, voltage source 116 delivers an electrical potential of between +4.6 and +5.6 kilovolts via a voltage compensating circuit 120 to tubular electrode element 56 to adjust the focus of the electron beam.

The equipotential surfaces 114 generated in the vicinity of first cylindrical portion 104*a* have a comparatively small radius of curvature that cooperates with the relatively low energy of the electron beam to strongly focus it. In contradistinction, the equipotential surfaces 114 generated in the vicinity of output end 108 (FIG. 4) have a comparatively large radius of curvature and function, therefore, to provide a transition from the strong lensing action that occurs near first cylindrical portion 104*a*.

Layers 58 and 62 provide bipotential electrode structure 50 with an outer electrode having a diameter 115 (FIG. 4) substantially equal to the inner diameter of neck portion 66 of glass envelope 52, thereby forming an outer electrode that is of the largest diameter that may be contained within neck port. As a result, the equipotential surfaces 114 (FIG. 3) are of a correspondingly large radius of curvature.

During the manufacture of cathode-ray tube 54, current-controlled arcs (i.e., spot-knocking arcs) are generated between conductive strip 62 and cylindrical portion 104*b* of tubular electrode element 56. The arcs function to remove field emission points (e.g., contamination) on the surface of cylindrical portion 104*b*, thereby to prevent uncontrolled electrical arcs from occurring between tubular electrode element 56 and conductive strip 62 during normal operation of cathode-ray tube 54. The arcs are generated in a manner known by persons skilled in the art.

FIG. 4 is an enlarged fragmentary side view showing the relative positions of bipotential electrode structure 50 and deflection yoke 98. With reference to FIG. 4, terminal end 64 of resistive layer 58 is positioned near output end 108 of tubular electrode element 56. Conductive strip 62 is deposited over terminal end 64 and partly overlaps cylindrical portion 104*b* of tubular electrode element 56. Conductive strip 62 has a width 122 along longitudinal axis 88 that is less than a distance 124 between deflection yoke 98 and conductive strip 62.

The width 122 of conductive strip 62 is less than its separation 124 from deflection yoke 98 and functions to reduce the magnitude of eddy currents generated in the strip by deflection yoke 98. The reduction of the magnitude of eddy currents in conductive strip 62 is desirable because they cause a loss of power in the beam-deflecting electromagnetic field generated by deflection yoke 98.

In particular, the comparatively narrow width of conductive strip 62 allows it to be separated from deflection yoke 98 by the comparatively large distance 124. Since the magnitude of the electromagnetic field generated by deflection yoke 98 decreases as a function of distance from deflection yoke 98, the electromagnetic field is relatively weak in the vicinity of conductive strip 62. Moreover, the magnitude of the electromagnetic field undergoes a relatively small change across conductive strip 62 because of its narrow width 122. As a result, eddy currents of relatively small magnitude are generated in conductive strip 62 by the electromagnetic field.

Figure 1:
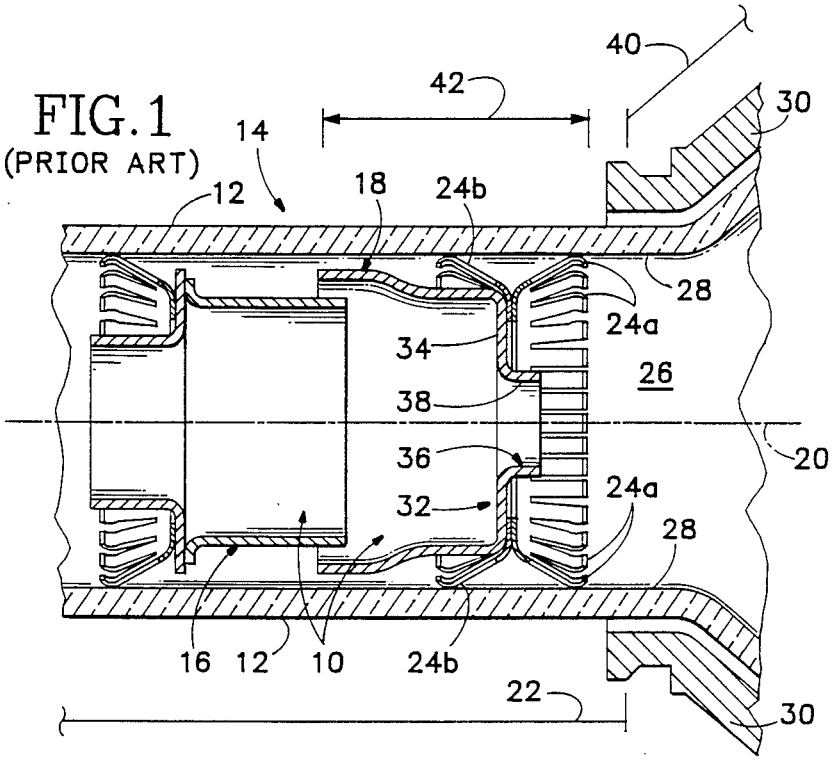
FIG. 1 (PRIOR ART)
FIG. 1 is a fragmentary longitudinal section view of a prior art bipotential lens structure in a cathode-ray tube.

With reference to the prior art bipotential electrode structure 10 shown in FIG. 1, outer cylinder electrode 18 and snubbers 24*a* and 24*b* have a combined width 42 of about 5 cm., and snubber 24*a* is positioned substantially adjacent to deflection yoke 30. The result of this arrangement is that the magnitude of the eddy currents generated in cylinder electrode 18 and snubbers 24*a* and 24*b* are substantially greater than the eddy currents generated in the conductive strip 62 of the present invention. The eddy currents of relatively large magnitude generated in bipotential lens 10 can cause a noticeable decrease in the efficiency of deflection yoke 30. Moreover, the cost of producing and installing outer electrode 18, snubbers 24*a* and 24*b*, and particle trap 32 is substantially greater than the cost of applying conductive strip 62 to interior surface 60 of envelope 52.

Conductive strip 62 reduces the likelihood of an arc developing between interior surface 60 and the exterior surface 128 of envelope 52 (i.e., "punch-through") by providing relatively high electrical and thermal conductivity in the vicinity of terminal end 64 of resistive layer 58. Whenever an arc occurs between tubular electrode element 56 and conductive strip 62, the electrical and thermal conductivity of conductive strip 62 allows the current in and the heat generated by the arc to be distributed in a substantially uniform manner in strip 62. As a result, the location at which the arc contacts conductive strip 62 does not become heated to a temperature that would allow "punch-through" to occur.

Conductive strip 62 may include any type of coating, film, or paint that has high electrical and thermal conductivity and that is compatible with the high-vacuum, high-voltage environment of a cathode-ray tube. In the preferred embodiment, conductive film 62 is formed from a commercially available silver paint manufactured by Dupont and identified as No. 7713, which is applied to interior surface 60 of evacuated envelope 52 in a liquid state. A conductive strip 62 formed from silver paint that is partly "dried out" tends, however, to peel or flake from interior surface 60. To prevent such peeling or flaking, the silver paint is preferably applied when it has a consistency similar to that of new or fresh silver paint.

Bipotential lens structure 10 is manufactured by applying a resistive material to interior surface 60 of envelope 62, thereby to form resistive layer 58. As shown in FIG. 4 of the preferred embodiment, the silver paint is applied to interior surface 60 of envelope 52 over first terminal end 64 of resistive layer 58 to form conductive strip 62. Tubular electrode element 56 is then positioned within envelope 52 in axial alignment with longitudinal axis 88 such that output end 108 is overlapped by conductive strip 62.

It will be obvious to those having skill in the art that many changes may be made in the above-described details of the preferred embodiment of the present invention without departing from the underlying principles thereof. For example, cathode-ray tube 54 could be a multiple beam electron discharge tube in which bipotential electrode structure 50 functions to converge multiple electron beams. The scope of the present invention should, therefore, be determined only by the following claims.

I claim

1. In an electron discharge tube having a tubular envelope with an inner diameter and within which beam producing means is positioned for producing an electron beam directed along a central longitudinal axis, the tube including beam deflecting means overlapping a portion of the tubular envelope for deflecting the electron beam, a bipotential electrode structure for converging the electron beam, comprising:

a layer of electrically resistive material applied to an interior surface of the portion of the tubular envelope overlapped by the beam deflecting means;

a tubular electrode element axially aligned with the central longitudinal axis and having an outer diameter that is less than the inner diameter of the tubular envelope;

a layer of conductive material applied to the interior surface of the tubular envelope in contact with the electrically resistive layer and overlapping a portion of the tubular electrode element; and voltage source means for applying a first electrical potential to the tubular electrode element and for applying a second electrical potential to the electrically resistive layer and the conductive layer.

2. The tube of claim 1 in which the conductive layer has electrically and thermally conductive properties.

3. The tube of claim 1 in which the resistive layer includes a terminal end positioned adjacent the tubular electrode element and in which the conductive layer is positioned over the terminal end of the resistive layer.

4. The tube of claim 1 in which the conductive layer is applied to the interior of surface of the tubular envelope in a liquid state.

5. The tube of claim 1 in which the beam deflecting means is separated from the layer of conductive material by a preselected distance along the central longitudinal axis and the layer of conductive material has a width that is less than the preselected distance between the beam deflecting means and the conductive layer.

6. The tube of claim 1 in which the beam deflecting means includes a magnetic deflection yoke.

7. The tube of claim 1 in which the beam producing means generates a single electron beam.

8. The tube of claim 1 in which the tubular envelope includes a glass neck portion within which the tubular electrode element is positioned.

9. In a cathode-ray tube having a tubular envelope with an inner diameter and within which beam producing means is positioned for producing an electron beam directed along a central longitudinal axis, a method of manufacturing a bipotential electrode structure for converging the electron beam, comprising:

applying a layer of electrically resistive material to an interior surface of the tubular envelope, the electrically resistive layer including a terminal end positioned between the beam deflecting means and the beam-producing means;

applying a layer of electrically conductive material to the interior surface of the tubular envelope and over the end of the resistive layer;

positioning a tubular electrode element within the tubular envelope in axial alignment with the central longitudinal axis, the tubular electrode element being positioned so that it is overlapped by the conductive layer; and positioning beam deflecting means along an exterior surface of the envelope for deflecting the electron beam, the beam deflecting means being positioned to overlap the layer of electrically resistive material.

10. The method of claim 9 in which the layer of conductive material is applied to the interior surface of the tubular envelope in a liquid state.

11. A cathode-ray tube, comprising:

a tubular envelope with an inner diameter and a central longitudinal axis;

beam producing means positioned within the tubular envelope for producing an electron beam that is directed along the central longitudinal axis;

a bipotential electrode structure having a layer of electrically resistive material applied to the interior surface of the tubular envelope, a tubular electrode element axially aligned with the central longitudinal axis and having an outer diameter that is less than the inner diameter of the tubular envelope, and a layer of conductive material applied to the interior surface of the tubular envelope in contact with the electrically resistive layer and overlapping a portion of the tubular electrode element;

voltage source means for applying a first electrical potential to the tubular electrode element and for applying a second electrical potential to the electrically resistive layer and the conductive layer;

a display screen toward which the electron beam is directed; and beam deflecting means positioned between the bipotential electrode structure and the display screen and overlapping the resistive material on the interior surface of the tubular envelope for deflecting the electron beam toward a selected location on the display screen.

12. The tube of claim 11 in which the conductive layer has electrically and thermally conductive properties.

13. The tube of claim 11 in which the resistive layer includes a terminal end positioned adjacent the tubular electrode element and in which the conductive layer is positioned over the terminal end of the resistive layer.

14. The tube of claim 11 in which the beam deflecting means is separated from the conductive layer by a preselected distance along the central longitudinal axis and the conductive layer has a width that is less than the preselected distance between the beam deflecting means and the conductive layer.

15. The tube of claim 11 in which the beam deflecting means includes a magnetic deflection yoke.

16. The tube of claim 11 in which the beam producing means generates a single electron beam.

17. In an electron discharge tube having a tubular envelope within which a bipotential electrode structure includes a tubular electrode element in cooperation with an electrically resistive layer on an interior surface of the tubular envelope to converge an electron beam propagating along the tube, which includes a beam deflection apparatus positioned along an exterior surface of the tube to deflect the electron beam, the improvement comprising:

a layer of electrically conductive material applied to the interior surface of the tubular envelope, in contact with the electrically resistive layer, and overlapping a portion of the tubular electrode element, and the beam deflection apparatus being positioned to overlap the electrically resistive layer.

18. The tube of claim 17 in which the resistive layer includes a terminal end positioned adjacent the tubular electrode element and in which the conductive layer is positioned over the terminal end of the resistive layer.

* * * * *